US006260707B1

(12) United States Patent
Harris

(10) Patent No.: US 6,260,707 B1
(45) Date of Patent: Jul. 17, 2001

(54) DISPLAY CONTAINER FOR REAL ESTATE SALES MATERIAL

(75) Inventor: Allen W. Harris, Columbia, SC (US)

(73) Assignee: FleetBoston Financial Corporation, Boston, MA (US)

( * ) Notice: Subject to any disclaimer, the term of this patent is extended or adjusted under 35 U.S.C. 154(b) by 0 days.

(21) Appl. No.: 09/494,697

(22) Filed: Jan. 31, 2000

(51) Int. Cl.[7] ..... B65D 71/00; B65D 5/50

(52) U.S. Cl. ..... 206/575; 206/457; 206/745; 206/756; 229/116.4; 446/478

(58) Field of Search ..... 206/575, 577, 206/457, 736–739, 756, 745, 763–765; 446/73, 76, 918, 988; 229/103, 116.4

(56) References Cited

U.S. PATENT DOCUMENTS

| | | | | |
|---|---|---|---|---|
| 1,662,100 | * | 3/1928 | Blum | 229/116.4 X |
| 1,690,178 | * | 11/1928 | Reeves | 229/116.4 X |
| 1,715,583 | * | 6/1929 | Warren | 229/116.4 |
| 1,899,241 | * | 2/1933 | Marr | 229/116.4 X |
| 2,084,308 | | 6/1937 | Behr . | |
| 2,686,980 | | 8/1954 | Carter . | |
| 2,872,753 | | 2/1959 | Fenton . | |
| 3,590,500 | * | 7/1971 | Smith | 206/457 X |
| 4,070,789 | * | 1/1978 | Levenson | 446/478 |
| 4,131,227 | | 12/1978 | Patton et al. . | |
| 4,662,519 | | 5/1987 | Ciociola . | |
| 4,806,102 | | 2/1989 | Pedersen et al. . | |
| 5,601,431 | | 2/1997 | Howard . | |

* cited by examiner

*Primary Examiner*—Bryon P. Gehman
(74) *Attorney, Agent, or Firm*—Harness, Dickey & Pierce, P.L.C.

(57) ABSTRACT

A house shaped carrying case and display assembly is herein disclosed. The house shaped carrying case and display assembly is comprised of an outer housing which includes a plurality of panels that define an internal compartment. Within the internal compartment is a display unit, utilized for displaying and receiving information and materials to and from a customer. The house shaped carrying case and display assembly is moveable between a first and second position, wherein in the first position the house shaped housing is operable as a carrying case and in the second position is operable as a display assembly.

16 Claims, 5 Drawing Sheets

DISPLAY CONTAINER FOR REAL ESTATE SALES MATERIAL

FIELD OF THE INVENTION

The present invention relates generally to the development of a carrying case as a display assembly and more particularly to the design of a house-shaped carrying case having the ability to unfold into a display assembly of the interior of the house for the presentation of literature and information to customers.

BACKGROUND OF THE INVENTION

The ability to display as well as collect information from customers is an important tool in different customer-oriented businesses. In a business setting, the capability to effectively and demonstratably communicate with customers is of key importance in the success of certain businesses. Today, with consumers more on the go, it is up to the businesses to reach out to the consumers.

A particular example of this need for flexible methods of communication is the development of a means for presenting information to people who are interested in financing the purchase of a home. Current time demands on individuals is such that it is difficult for people to obtain all the necessary information in a timely fashion. A display assembly related to the mortgage/real estate field would enable individuals to obtain information relative to their home search and finding needs. In addition to the potential home owner obtaining information, the display assembly allows the potential purchaser to leave contact information so that the lender and realtor utilizing the display may pursue future contact. The display assembly provides a means for communicating with a customer and aiding in the process of home selection and financing from the perspective of the potential home owner on the one hand, and as a lender and realtor on the other.

The present invention provides the ability to convey information to a sales site, such as a realtor's open house event. When opened to reveal the interior of the house, it also provides for the displaying of information to, as well as obtaining information from, a potential home owner. In addition to displaying information, the present invention enables a complete method of communicating with a potential homeowner without the need for an individual to be present to facilitate that communication.

The purchasing of a new home, and the financing thereof, has the potential to be a stressful period due to the amount of time demanded of the purchaser and the complexity of the transactions. The present invention can minimize the time that potential home owners spend in researching property and finance information, by having them both located at a convenient location, and eases the complexity of the transactions by providing for a unique method of distributing explanatory information.

SUMMARY OF THE INVENTION

It is an object of the present invention to be utilized as a carrying case as well as a display assembly to present information and materials to a potential homeowner. In this particular invention, the carrying case is a house-shaped carrying case and includes a plurality of panels defining an internal compartment. It is within the configuration of these panels that a house-shaped outer housing is obtained. Within the internal compartment of the house-shaped carrying case is a display unit which is presented upon unfolding the outer housing into a laid-out position.

It is a further object of this invention to display a house-like facade on the external and internal panels of the house shaped carrying case and display assembly. When the carrying case is in its house-shaped configuration, the external panels present a facade of the exterior of a house. Once the carrying component of the present invention is no longer being utilized, the carrying case can be converted into a display assembly. The display assembly presents an internal facade of a house.

It is still further an object of this invention to provide an easy-to-follow and complete display of the materials necessary for a potential homeowner. In addition to displaying information to a future homeowner, information can be readily obtained from the potential homeowner by using the display unit. In regards to the display unit located in the internal compartment of the house-shaped carrying case, the display unit is designed to provide a plurality of receptacles or compartments to obtain and present information to the consumers.

Additional areas of applicability of the present invention will become apparent from detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
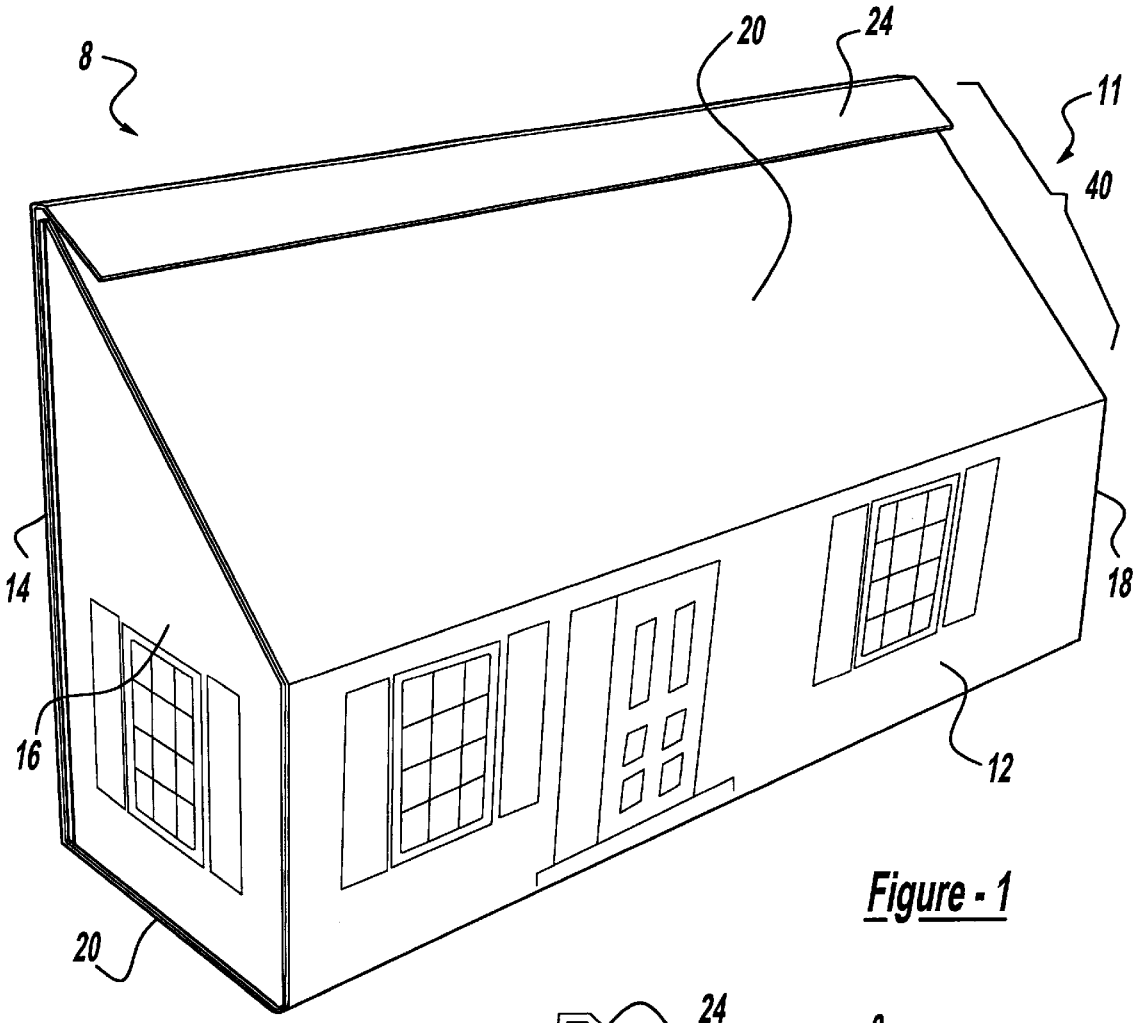
FIG. 1 is a frontal perspective view of the house shaped carrying case.

Referring first to FIG. 1 which is a frontal perspective of a house-shaped carrying case 8 and display assembly 10, the house-shaped carrying case 8 includes an outer housing 11 comprised of a base portion 22, two fixed side panels 16 and 18, a back panel 14, a front panel 12, a roof panel 20, as well as an extended closure flap 24.

Figure 2:
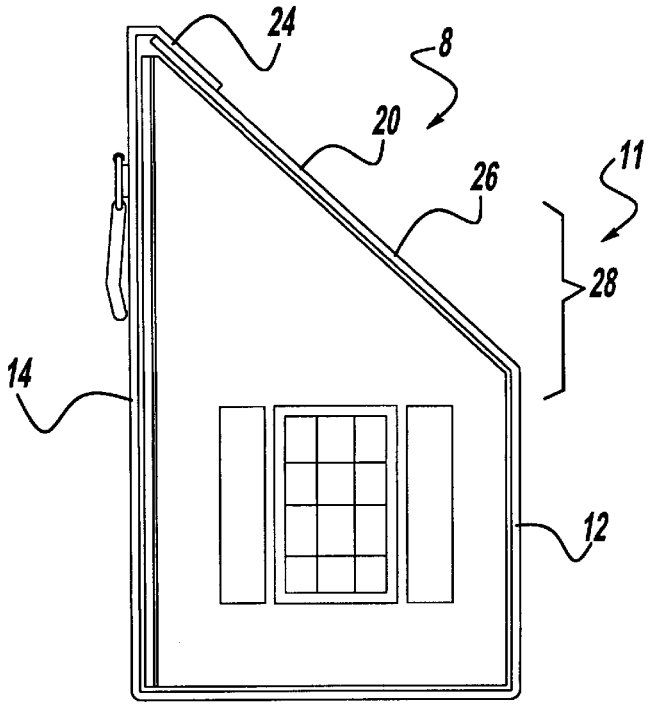
FIG. 2 is a side plan view of the house shaped carrying case indicating the closure attachment of the two panels to complete a house shaped configuration.
Figure 5:
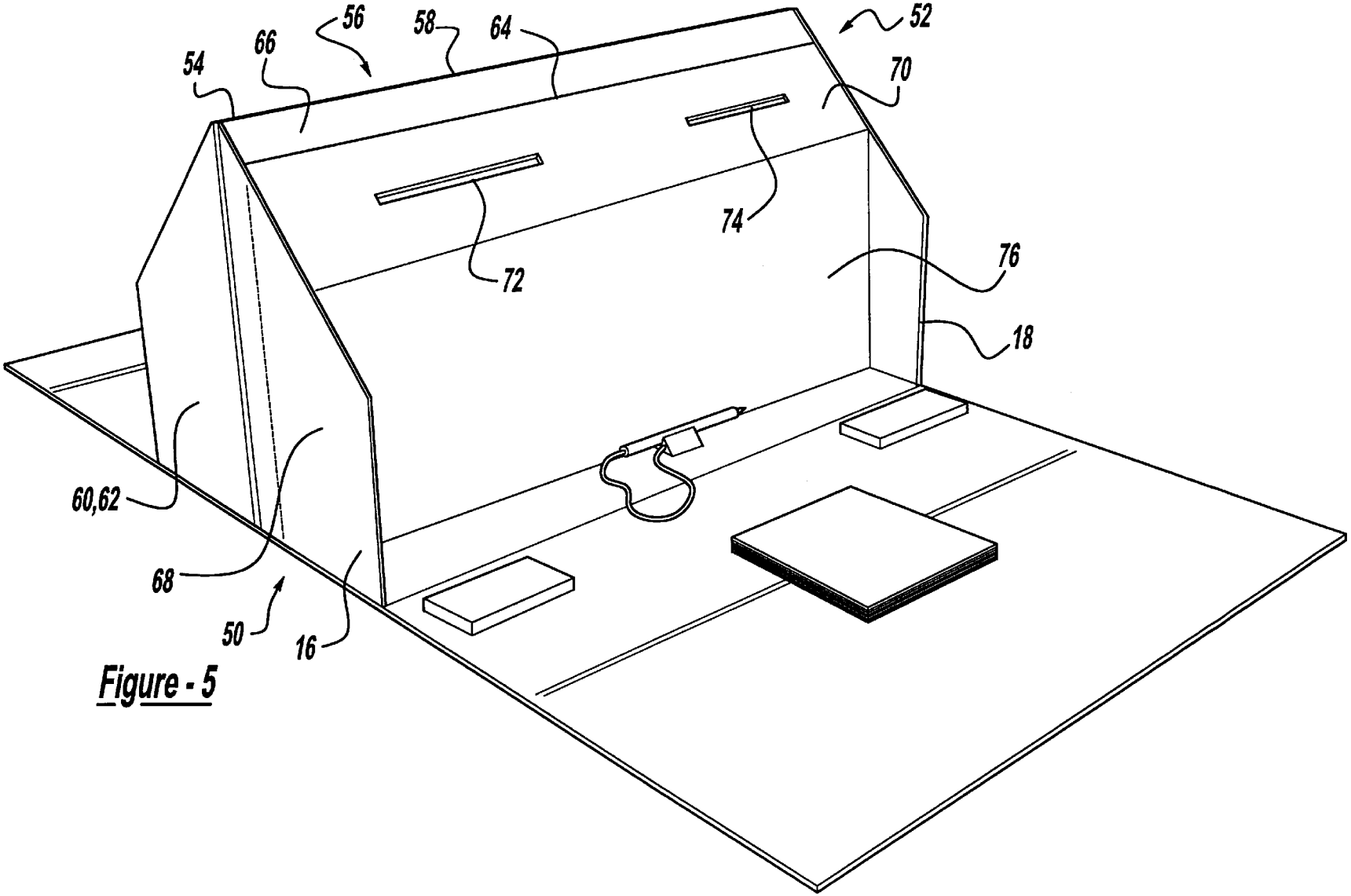
FIG. 5 is a frontal perspective of the house-shaped carrying case in a converted configuration wherein the carrying case is acting as a display assembly.
Figure 7:
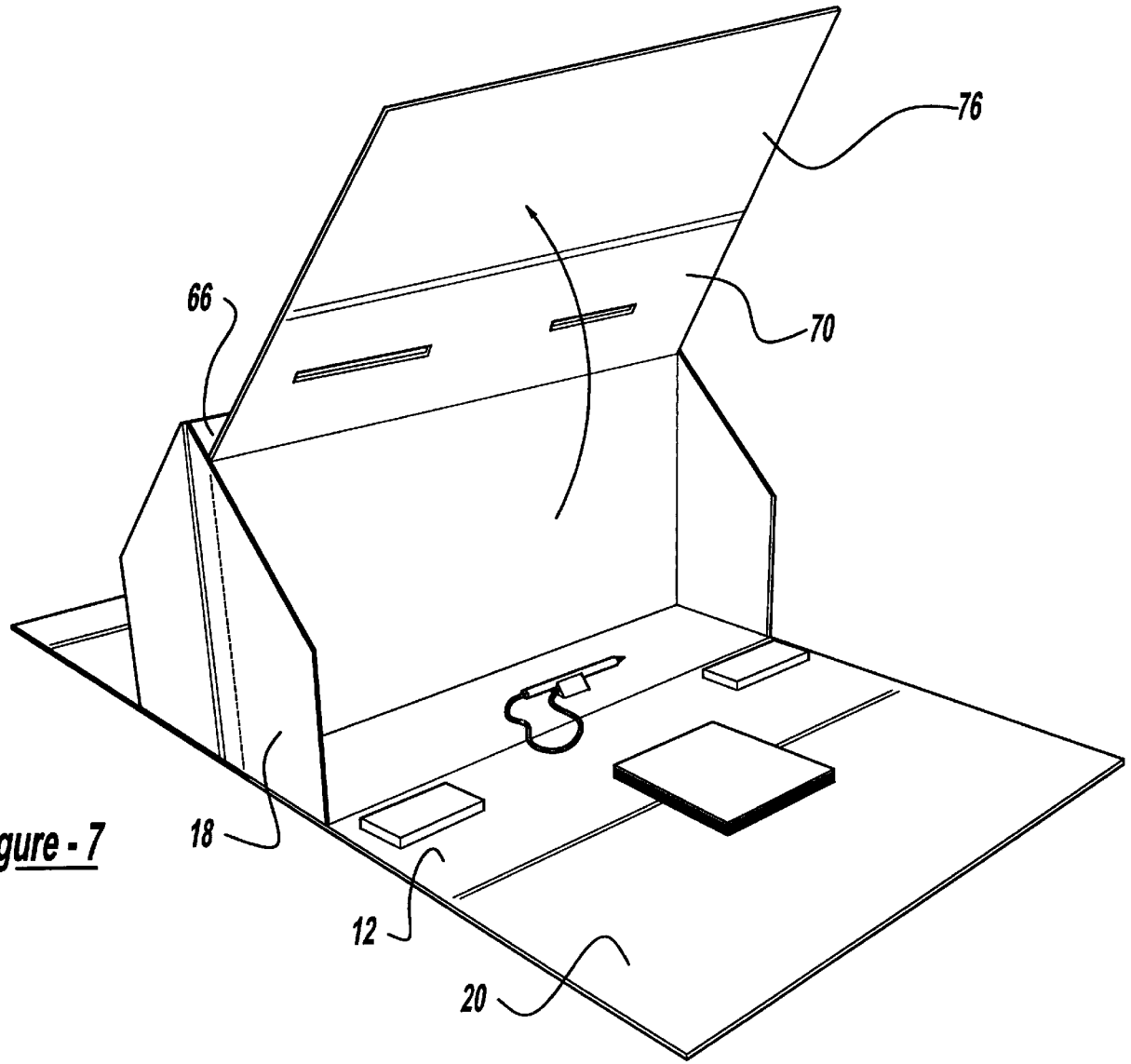
FIG. 7 is a side perspective view of the display assembly which includes a phantom outline of the potential movement of the receptacle panels as well as movement of the back side panels.

Turning to FIGS. 2 and 5, the house shaped carrying case 8 includes an upright internal compartment 26. The compartment 26 is disposed between the two fixed side panels 16 and 18 and surrounded by moveable front panel 12, back panel 14, roof panel 20 as well as the extended closure flap 24. The front panel 12 and the roof panel 20 define a first portion 28 of the outer housing 11. The back panel 14 and extended closure flap 24 define a second portion 30 of the outer housing 11.

Figure 3:
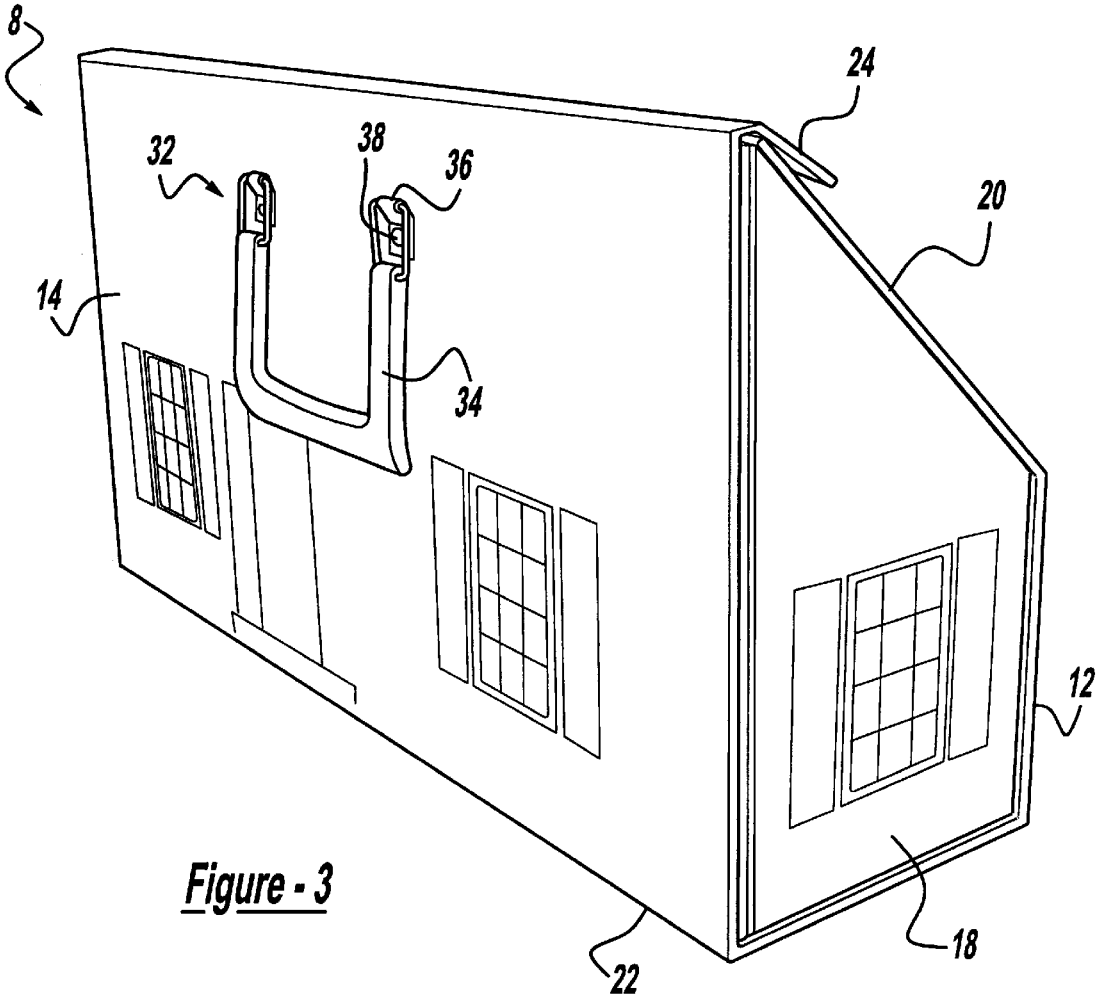
FIG. 3 is a back perspective of the house shaped carrying case indicating the location of a carrying handle upon the back panel of the house shaped carrying case.

As seen in FIG. 3, the back perspective view of the house shaped carrying case 8, a carrying handle 32 is disposed on the back panel 14 of the carrying case 8. The handle 32 enables easy transport of the carrying case 8. In this particular embodiment, the carrying handle 32 is a plastic handle 34 connected to the back panel 14 by metal fastener means 36 and 38. One skilled in the art recognizes that a carrying handle 32 as well as its attachment means could be comprised of different materials in addition to the ones presented in this particular configuration.

In regard to FIGS. 1–3 which provides the multiple perspectives of the outer housing 11 of the carrying case 8, the outer housing 11 is decorated in a fashion which represents the facade of the exterior of a house. This includes on the front panel 12 a door and a plurality of windows or any other frontal external features that are found on a house. The roof portion 40 which is comprised of the roof panel 20 and extended closure flap 24 are decorated to reflect the design of a roof which includes shingles. The back panel 14 also includes an extended portion of the roof as well as the facade of the back of a house. In addition to the decorative features of the outer housing 11, the name and logo of the business can be displayed on the outer housing 11 of the house shaped carrying case 8.

Figure 4:
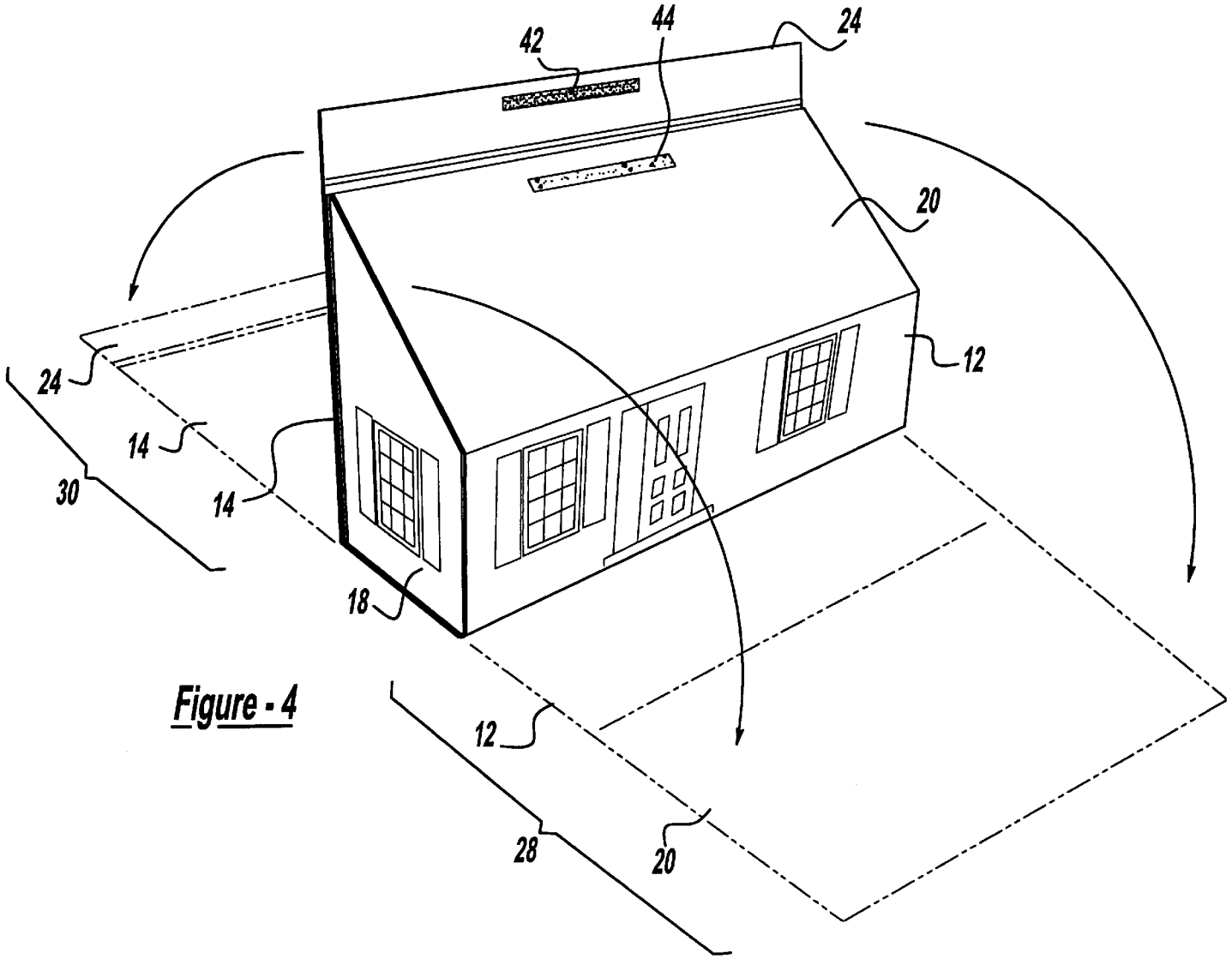
FIG. 4 is a frontal perspective view of the house shaped carrying case demonstrating the display assembly configuration and potential movement of panels.

In reference to FIG. 4, the house shaped carrying case 8 is seen in the display assembly configuration. The outward extension of the first portion 28 and second portion 30 of the house shaped carrying case 8 are in a horizontal position. A hook and loop mechanism, 42 and 44 couples the closure flap 24 with the front panel 20 in order for the outer housing 11 to transform into a display assembly the hook and loop mechanism, 42 and 44 must be released. The hook and loop mechanism 42 and 44 includes a strip of hook-type fastener material, as well as a strip of loop-type fastener material. One portion of the hook and loop mechanism 42 and 44 is disposed on the underneath side of the extendable closure tab 24 with the other component disposed on the external side of the roof panel 20. The hook and loop mechanism 42 and 44 which may include VELCRO™ allows for the closure of the plurality of panels which comprise the outer housing 11 to maintain a house shaped configuration. Upon the release of the hook and loop mechanism 42 and 44, the first 28 and second 30 portion of the outer housing 11 are movable resulting in a laid out position, as can be initially seen in multiple perspectives in FIGS. 4–7.

With particular reference to FIG. 5, the display assembly 10 can be seen in its entirety. The main structural components of the display assembly 10 includes a display unit 50 which is an upright configuration of a plurality of compartments and receptacles as well as the internal side of the front portion 28 of the outer housing 11 which provides a location for information to be displayed.

Figure 6:
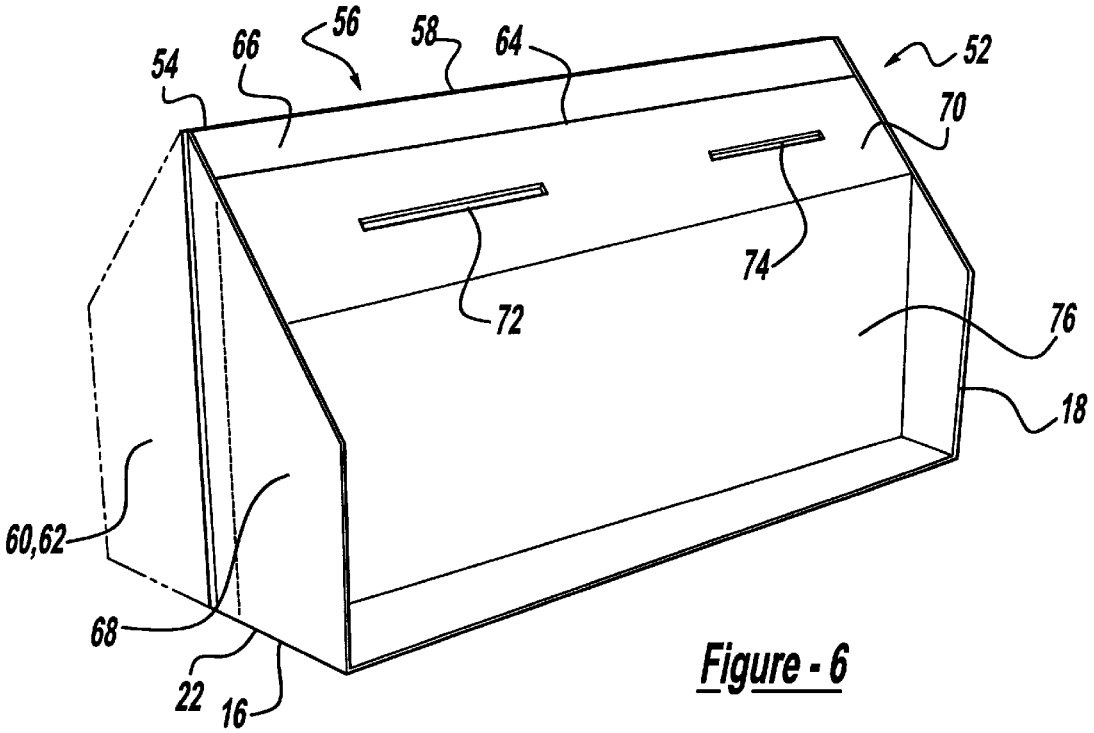
FIG. 6 is an enlarged view of the display unit within the display assembly.

As seen in FIG. 6, the display unit 50 includes multiple compartments and receptacles. The display unit 50 is defined by a first display unit back support 52 which is folded into three panels. All three panels are fixedly attached to the base portion 22 of outer housing 11. The three panels of the first display unit back support 52 are the first display unit back panel 54 and the two fixed side panels 16 and 18 of the outer housing 11. Affixed on the opposite side of the first display unit back panel 54 is a second display unit back support 56 folded into three panels. The second display unit back support 56 includes of a second display unit back panel 58, which is fixedly attached to the base portion 22 of the outer housing 11 as well as the first display unit back panel 54, and two hingedly attached moveable back side panels 60 and 62. The back side panels 60 and 62 are not attached to the base portion 22 of the outer housing 11. Thus, the panels 60 and 62 move into a side position. A front holding compartment panel 64 is disposed in front of the display unit back panel 54 and fixedly attached to the base portion 22 of the outer housing 11. A holding compartment 66 is located in between the first display unit back panel 54 and the front holding compartment panel 64. The holding compartment 66 retains information and material relevant to this particular invention. The information may include property information as well as finance information for future home owners.

The front holding compartment panel 64, which serves as a boundary for the holding compartment 66, also serves as a back for the receptacle compartment 68. A receptacle panel 70 is hingedly attached to the front holding compartment panel 66. The receptacle panel 70 includes two receptacle slots 72 and 74 to receive information from customers. In reference to this particular invention, the receptacle slots 72 and 74 disposed on the receptacle panel 70 are labeled as including guest cards and business cards. A frontal display panel 76 is hingedly attached to the receptacle panel 70. The frontal display panel 76 serves as a front portion to the receptacle compartment 68.

The frontal display panel 76 is not attached to the base portion 22 of the outer housing 11. Thus, the frontal display panel 76 may move into an upright position. The movement of the frontal display panel 76 enables retrieval of information placed in the receptacle compartment 68 via the receptacle slots 72 and 74. The movement of the frontal display panel 76 can been seen in relation to the display unit 50 in FIG. 7.

Other elements are included with the display unit 50 within the display assembly 10. Multiple card holders 80 and 82, a mount 84 for a writing assembly and a location for guest cards 86 are all mounted on the internal side of the first portion 28 of the outer housing 11 can be seen in FIG. 5.

In addition to all of the above components of the display assembly 10, the display assembly 10 panels are decorated to simulate an internal room facade which portrays the internal design of a house. In addition to the front portion 46 of the display assembly 10 which is the inside view of the first portion 28 of the outer housing 11 as seen in FIG. 4, a back portion 48 can be seen in FIG. 7. The back portion 48 of the display assembly 10 includes the internal side of the second portion 30 of the outer housing 11. The back portion 48 of the display assembly 10 serves as a work space or storage area. Upon completion of displaying information to customers by utilizing the display assembly 10, the outer housing 11 is moveable in an upward direction and closes using the hook and loop mechanism 42 and 44, thereby resuming the configuration of a house shaped carrying case 8.

The above-mentioned invention being thus described, it will be apparent that the same may be varied in many ways. Such variations are not to be regarded as a departure from the spirit and scope of the invention and all such modifications as would be apparent to one skilled in the art are intended to be included within the scope of the following claims.

What is claimed is:

1. A house shaped carrying case and display assembly comprising:

an outer housing including a plurality of panels, said plurality of panels defining an internal compartment and said plurality of panels positioned with respect to one another to provide a house shaped housing;

a display unit disposed with said internal compartment; and said panels being moveable between a first position and a second position, said panels in said first position defining said house shaped housing and operable as said carrying case and said panels moving to said second position providing access to said internal compartment and operable as said display assembly with means providing real estate procurement information to a user.

2. A house shaped carrying case and display assembly as recited in claim 1 wherein said housing includes a front panel, a roof panel, a back panel, two fixed side panels, a base portion and an extended closure flap.

3. A house shaped carrying case and display assembly as recited in claim 2 wherein said carrying case includes a carrying handle.

4. A house shaped carrying case and display assembly as recited in claim 3 wherein said carrying handle is disposed on said back panel and consists of a plastic handle, metal attachments, and fasteners.

5. The house shaped carrying case and display assembly as recited in claim 1 wherein said housing is comprised of a first portion and a second portion, wherein said first portion consists of a front panel and a roof panel, wherein said second portion consists of a back panel and an extended closure flap.

6. The house shaped carrying case and display assembly as recited in claim 5 wherein said first and second portions are hingedly attached to a base portion.

7. The house shaped carrying case and display assembly as recited in claim 1 wherein said display unit further comprises:

a first display unit back support;

a second display unit back support, wherein said second display unit back support is affixed behind said first display unit back support;

a front holding compartment panel, wherein said holding compartment panel is located in front of said first display unit back support;

a holding compartment, wherein said holding compartment is located between said first display unit back support and said front holding compartment panel;

a receptacle panel, wherein said receptacle panel is hingedly attached to said front holding compartment panel;

a plurality of receptacle slots disposed upon said receptacle panel;

a frontal display panel, wherein said frontal display panel is hingedly attached to said receptacle panel; and said frontal display panel is moveable in an upward direction revealing a receptacle compartment.

8. The house shaped carrying case and display assembly as recited in claim 7 wherein said first display unit back support includes a first display unit back support panel and two fixed side panels.

9. The house shaped carrying case and display assembly as recited in claim 7 wherein said second display unit back support includes a second display unit back support panel and two hingedly attached back side panels.

10. A house shaped carrying case and display assembly comprising:

an outer housing including a plurality of panels, said plurality of panels defining an internal compartment, said internal compartment having means providing real estate procurement information to a user, and said plurality of panels positioned with respect to one another to provide a house shaped housing;

a handle disposed on one of said plurality of panels, wherein said handle has means for transporting said carrying case; and a hook and loop mechanism wherein said hook and loop mechanism includes a strip of hook-type fastener material disposed on one of said outer panels and a strip of loop-type fastener material disposed on another one of said outer panels which is opposite said hook-type fastener material.

11. A house shaped carrying case and display assembly as recited in claim 10 wherein said hook and loop mechanism further includes two portions wherein a first portion is disposed on a closure extension panel and wherein a second portion is disposed on external side of a roof panel.

12. A house shaped carrying case and display assembly comprising:

an outer housing including a plurality of panels, said plurality of panels defining an internal compartment and said plurality of panels positioned with respect to one another to provide a house shaped housing;

said outer housing decorated to reflect an exterior house facade; and said internal compartment decorated to reflect the interior of a house, wherein said internal compartment includes multiple rooms and means providing real estate procurement information to a user.

13. A house shaped carrying case and display assembly, wherein said display assembly further comprises:

an internal surface of a plurality of panels, wherein said plurality of panels are positioned with respect to one another to provide a display assembly;

said plurality of panels comprise a first portion and a second portion extended in opposite directions, wherein a display unit is disposed between said first portion and said second portion;

said display unit further includes a holding compartment and a receptacle compartment;

multiple card holders, wherein said card holders are disposed on first portion;

a mount for a writing apparatus, wherein said mount is disposed on inner surface of said first portion; and a pad disposed on inner surface of said second portion, wherein said pad allows for guests to register.

14. A house shaped carrying case and display assembly as recited in claim 13 wherein said holding compartment is disposed between a first display unit support panel and a holding compartment panel.

15. A house shaped carrying case and display assembly as recited in claim 13 wherein said receptacle compartment is enclosed be a holding compartment panel, a receptacle panel, wherein said receptacle panel further includes a plurality of receptacle slots, and a frontal display panel.

16. A house shaped carrying case and display assembly as recited in claim 15 wherein said front display panel is moveable in an upwards direction to reveal said receptacle compartment, wherein said receptacle compartment contains information left by a customer.

* * * * *